US011696628B2

(12) United States Patent
Herrera et al.

(10) Patent No.: US 11,696,628 B2
(45) Date of Patent: Jul. 11, 2023

(54) KEY ORGANIZER

(71) Applicants: Ivan J. Soto Herrera, Vista, CA (US); Julia A. Soto, Vista, CA (US); Luis O. Soto Herrera, Vista, CA (US); Prisciliano Soto Arzate, Vista, CA (US)

(72) Inventors: Ivan J. Soto Herrera, Vista, CA (US); Julia A. Soto, Vista, CA (US); Luis O. Soto Herrera, Vista, CA (US); Prisciliano Soto Arzate, Vista, CA (US)

( * ) Notice: Subject to any disclaimer, the term of this patent is extended or adjusted under 35 U.S.C. 154(b) by 0 days.

(21) Appl. No.: 17/530,133

(22) Filed: Nov. 18, 2021

(65) Prior Publication Data

US 2022/0151357 A1 May 19, 2022

Related U.S. Application Data

(60) Provisional application No. 63/115,305, filed on Nov. 18, 2020.

(51) Int. Cl.
*A45C 11/32* (2006.01)

(52) U.S. Cl.
CPC ..... *A45C 11/324* (2013.01)

(58) Field of Classification Search
CPC ..... A45C 11/34; A45C 11/32
USPC ..... 206/37.1, 37.5, 37.8; 70/456 R, 456
See application file for complete search history.

(56) References Cited

U.S. PATENT DOCUMENTS

| | | | | |
|---|---|---|---|---|
| 2,822,684 | A * | 2/1958 | Ray | E05B 19/043 70/456 R |
| 4,422,316 | A * | 12/1983 | Thomas | A47G 29/10 70/456 R |
| 5,199,560 | A * | 4/1993 | Lee | A45C 11/324 206/37.5 |
| 5,495,942 | A * | 3/1996 | Izhak | B25F 1/04 206/37.8 |
| 7,127,922 | B2 * | 10/2006 | Khounsombath | A45C 11/324 7/118 |
| 7,726,161 | B2 * | 6/2010 | Canard | E05B 19/043 70/DIG. 52 |
| 8,418,843 | B2 * | 4/2013 | Palmer | A45C 11/324 206/37.1 |
| 8,695,389 | B2 * | 4/2014 | Gueble | E05B 19/043 70/459 |
| 11,229,267 | B2 * | 1/2022 | Van Der Laan | A45C 11/324 |

* cited by examiner

*Primary Examiner* — Jacob K Ackun
(74) *Attorney, Agent, or Firm* — Donn K. Harms

(57) ABSTRACT

A key organizer, having a housing and a reel pivotally engaged therewith, is configured for engagement of a key with said reel. The reel has a first position holding a key engaged therewith, within an internal housing of the housing. The reel is pivotable to a second position wherein a second end of a key engaged therewith is engageable with a lock to actuate it.

11 Claims, 3 Drawing Sheets

KEY ORGANIZER

This application claims priority to U.S. Provisional Patent Application Ser. No. 63/115,305 filed on Nov. 18, 2020, which is incorporated herein in its entirety by this reference thereto.

FIELD OF THE INVENTION

The present device relates to keys, such as those employed for door locks and padlocks. More particularly, the disclosed device relates to a portable key organizer which maintains stored keys within a storage cavity until they are pivoted to a position for deployment and use.

BACKGROUND OF THE INVENTION

Throughout the world, businesses and homes alike have doors which are secured by key-actuated locks. Conventionally, to gain access to a locked door, only authorized persons will have the appropriate key which is required to open and close the door lock of the home or business.

While modern automobiles have evolved to employ electronic locks and keys, a majority of homes and businesses still use key-engageable locks to secure the door when desired or when workers or owners are not present. Further, a large percentage of padlocks, which secure gates and garages and the like, still use keys. As a consequence, many people must carry with them, multiple keys, to be able to open multiple doors and other lock-secured venues.

A common holder, for those having multiple keys, is a key ring which is configured from a ring which is adapted to flex and engage through openings in keys to hold them. Another common holder for multiple keys is a key chain, which conventionally has removably engaged ends, which, when separated allows the user to thread the chain or cable through the openings provided for such, in multiple keys.

However, keys on such rings, cables, and chains are loose and exposed during storage in a pocket or purse or the like, when not in use. This exposure can result in damage to the keys themselves, in some instances from contact with the contents of a pocket or purse. Additionally, the edges of most keys have recesses in between projecting ridges which can be pointed and in some cases sharp. Such can easily cause scratching of the other contents of a pocket or purse such as a smartphone.

Still further, many people who have to visit multiple locations with locked doors tend to carry multiple keys to open them as a part of their daily routine. Once they retrieve the ring engaged keys from a pocket or purse for use, they must sort through them to find the correct key for the moment, which can be time consuming and in the dark of an evening, frustrating.

The forgoing background concerning conventional key holding devices such as rings and cables, and limitations related therewith, are intended to be illustrative and not exclusive, and they do not imply any limitations on the invention described and claimed herein. Various other limitations of the related art are known or will become apparent to those skilled in the art upon a reading and understanding of the specification below and the accompanying drawings.

SUMMARY OF THE INVENTION

The portable key organizer device herein disclosed provides for the engagement and organizing of multiple keys upon a single key holding organizer. The device, as disclosed, allows for the storage of multiple keys upon a key reel. The multiple keys, when not in use, are maintained upon the key reel in a protected position retracted within an interior cavity of a surrounding housing.

The keys are engaged to the key reel. This engagement is accomplished by positioning a central member communicating between the two sidewalls of the key reel, through a securement opening formed in the key. Such securement openings are well known in the art as they are located at the head end of the key and communicate through most keys at that end. This allows the key head to be engaged to a key ring or chain but still allows the key to be engaged for use in the keyway of a lock. By positioning the central member of the key reel to communicate through multiple securement openings of multiple keys, they may all be adjacently engaged upon the key reel. Such is easily accomplished by removal of one sidewall of the key reel to expose a distal end of the central member.

The keys, so engaged to the key reel, are preferably maintained in place thereon and prevented from rotating upon the central member, by a frictional restraint. The frictional restraint herein employs a biasing member such as a spring, to impart a biasing force against the keys, so that they are held by friction in a substantially static positioning upon the key reel. The frictional restraint herein employs the biasing member to impart force against a first of the keys engaged to the drum or central member, which in turn will cause each adjacent key to contact the surface of a key positioned next to it. The multiple keys are, thus, compressed against each other and a second wall of the key reel by this biasing force, and the resulting frictional contact between the keys and against the second wall of the key reel is sufficient to hold the keys in place on the key reel, until moved or rotated by the fingers of the user.

The key reel, on which the key or keys is engaged, is in a pivoting connection with a housing of the device. This pivoting connection allows the key reel to move between a first position and a second position. In the first position, the keys projecting from engagement to the central member extend from the key reel where the engagement ends of the keys are located within an internal cavity of the housing. With the key reel in this position, the keys are surrounded on three sides by the housing and spaced from an opening in the housing communicating with the internal cavity.

The key reel, as noted, is pivotable from the first position to a second position. When the key reel is in this second position, the engagement ends of keys secured to the key reel are moved out of the internal cavity, and they will project past the circumference of both sidewalls of the key reel. They will, thus, be visible to the user who may rotate them slightly in their engagement to the key reel, to find the appropriate key for the lock to be opened.

The key reel is movable between the first position and the second position, by contact with a projection extending from one or both side walls of the key reel. A center wall may be included which communicates across a gap between the first and second sidewall of the key reel. This center wall forms a cover for the interior of the key reel.

With the key reel in a pivoting connection to the housing of the device, the user can actuate the key reel to pivot back and forth between the first position and second position, by imparting force to the projection extending from both sidewalls, and/or the center wall extending therebetween.

With the key reel actuated to the first position, as noted, it locates the keys extending from their engagement with the key reel within the internal cavity of the housing. With the key reel actuated to the second position, as noted herein, the keys will be located outside the interior cavity where the portions thereof extending from the key reel may be sorted or chosen for use by individually rotating the keys on their engagement to the central member or drum of the key reel.

With respect to the above description, before explaining at least one preferred embodiment of the herein disclosed key organizer invention in detail, it is to be understood that the invention is not limited in its application to the details of construction and to the arrangement of the components in the following description or illustrated in the drawings. The key organizer device herein described and shown is capable of other embodiments and of being practiced and carried out in various ways which will become obvious to those skilled in the art upon reading this disclosure. Also, it is to be understood that the phraseology and terminology employed herein are for the purpose of description and should not be regarded as limiting.

As such, those skilled in the art will appreciate that the conception upon which this disclosure is based may readily be utilized as a basis for the designing of other key organizers or key caddy structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. The term "substantially", unless otherwise specifically defined, means plus or minus five percent.

It is an object of the present invention to provide a lightweight and easy to use key organizer, which is easily stored in a pocket or purse.

It is an additional object of this invention to provide such a key organizer which maintains engaged keys protected within an internal cavity until they are deployed therefrom by the user.

It is yet another object of the invention herein, to provide such a key organizer which is configured for a user to easily pivot keys from storage in an internal cavity, to a position for sorting and use by the user for locks and which is easy for the user to re-position engaged keys back to a retracted position.

It is a further object of this invention to provide a key organizer which maintains engaged keys within an interior cavity when the device is in a pocket or purse, to prevent contact of sharp key edges with easily scratched items which may be placed adjacent the key organizer.

These and other objects, features, and advantages of the present key organizer invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the disclosed key organizer device herein. It is intended that the embodiments and figures disclosed herein are to be considered illustrative of the invention herein, rather than limiting in any fashion.

Figure 1:
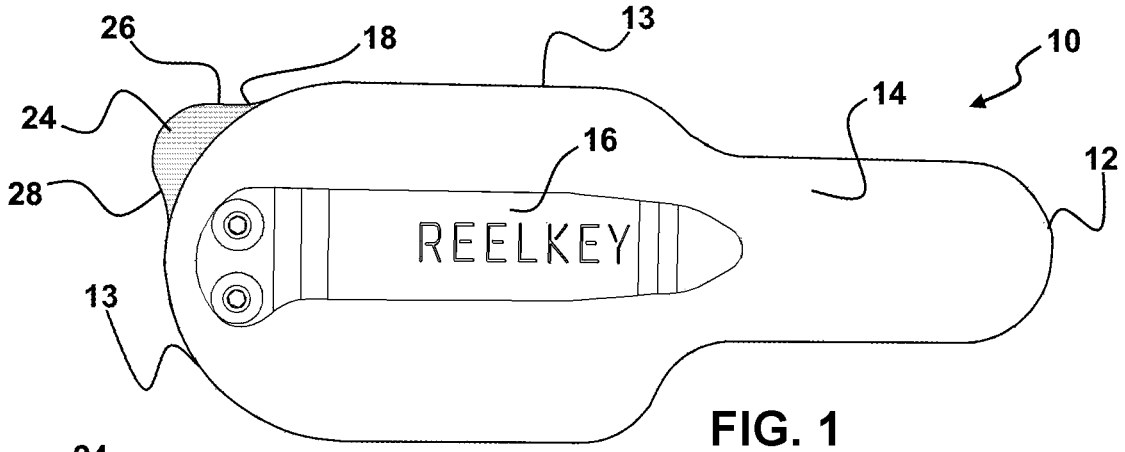
FIG. 1 depicts the key organizer device herein from a first side view of the housing and showing a projection extending from the key reel configured for pivoting the key reel from a retracted position to a deployed position.
Figure 2:
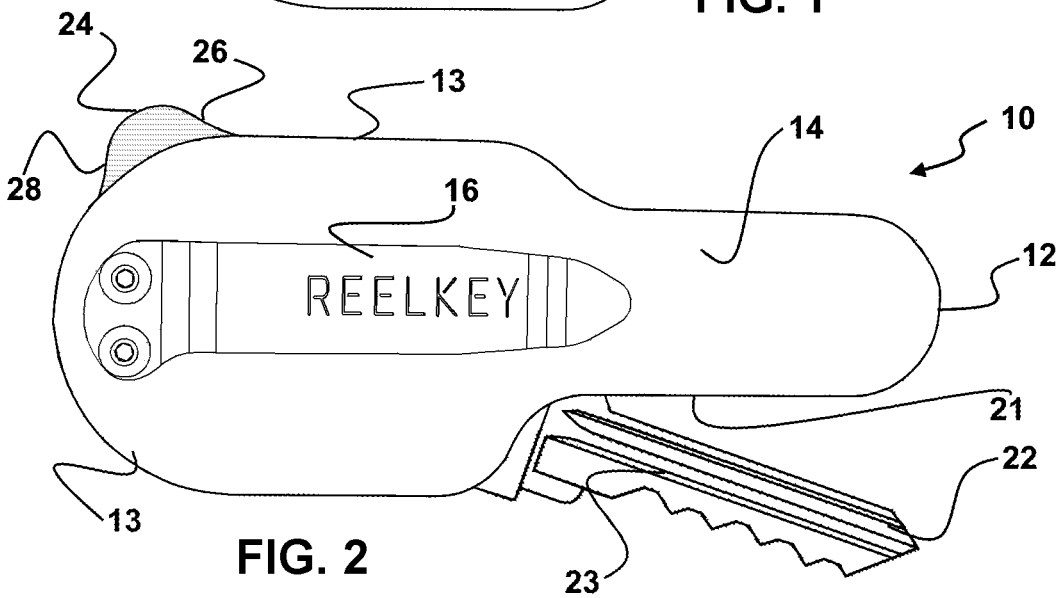
FIG. 2 shows the device as in FIG. 1, wherein the projection extending from the key reel is moved to the deployed position thereby pivoting the key reel to cause keys engaged thereto to project from the internal cavity of the device.
Figure 3:
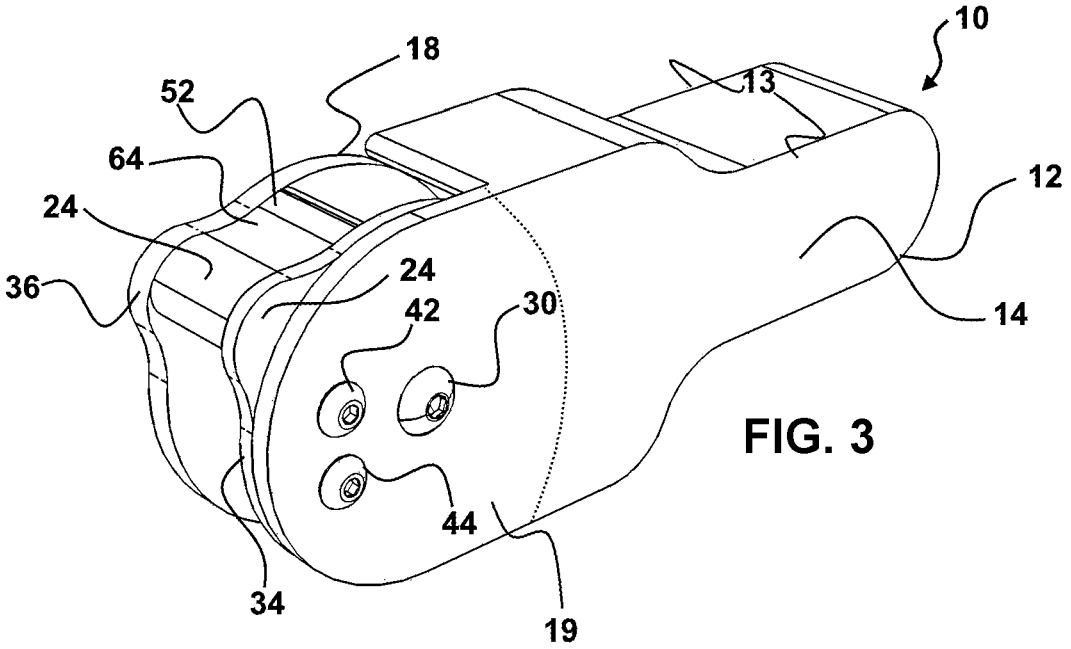

FIG. 3 displays the device of FIGS. 1-2 wherein a clip has been removed to show an engageable center pin on which the reel pivots when actuated by the projection.

Figure 4:
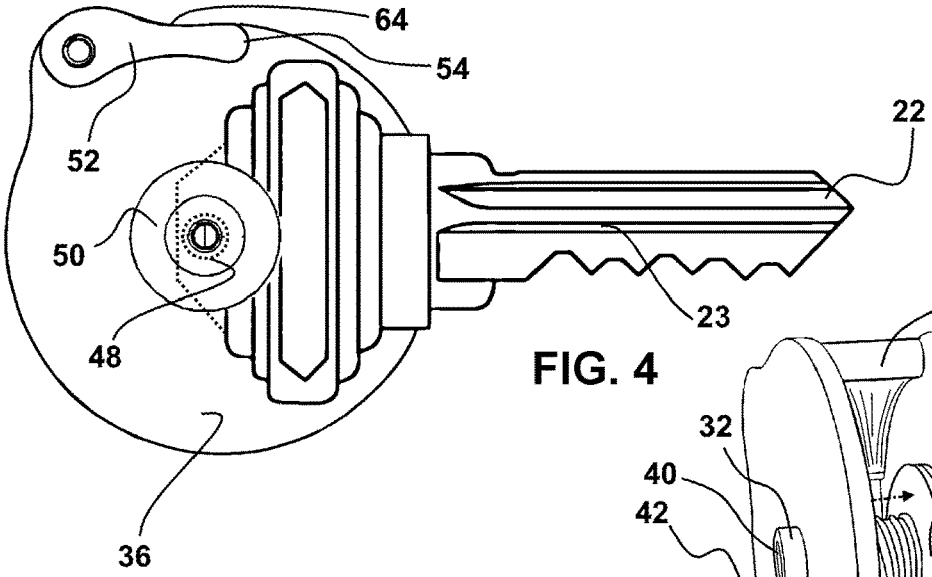

FIG. 4 shows the key reel removed from the housing of the device, with one side of the key reel removed for clarity, and showing a pivoting member configured to contact and rotate keys from the internal cavity as the key reel is pivoted.

Figure 5:
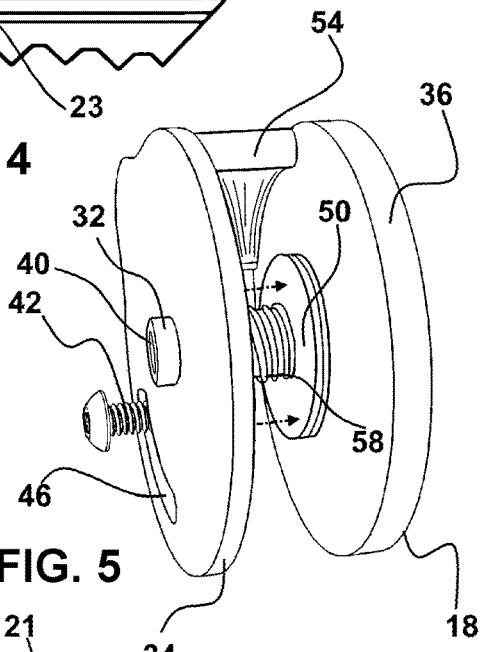

FIG. 5 depicts the key reel removed from the a rotationally engaged position with the housing and showing a frictional restraint which imparts a biasing force to one or more keys engaged to the key reel, to maintain them in a static position.

Figure 6:
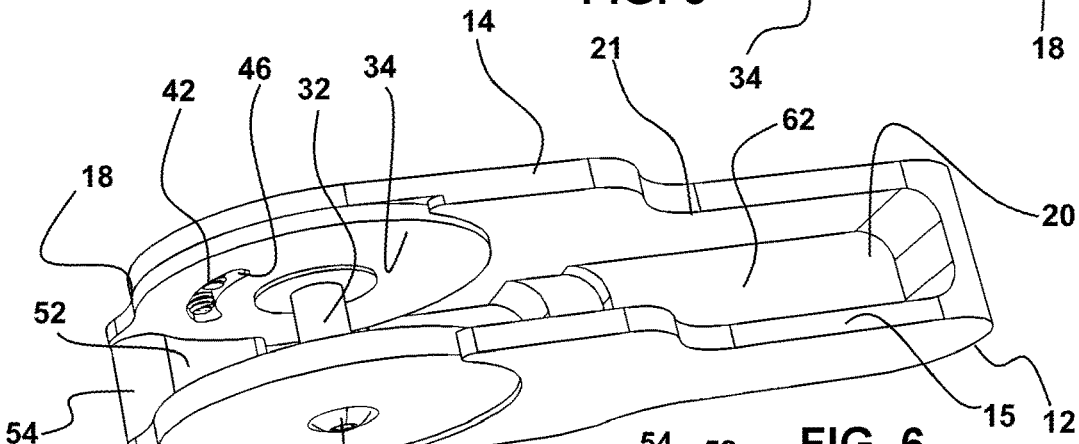

FIG. 6 depicts a perspective lower side view of the device of FIGS. 1-3, showing the key reel in a pivoting engagement with the housing, and showing an internal cavity in which keys are stored.

Figure 7:
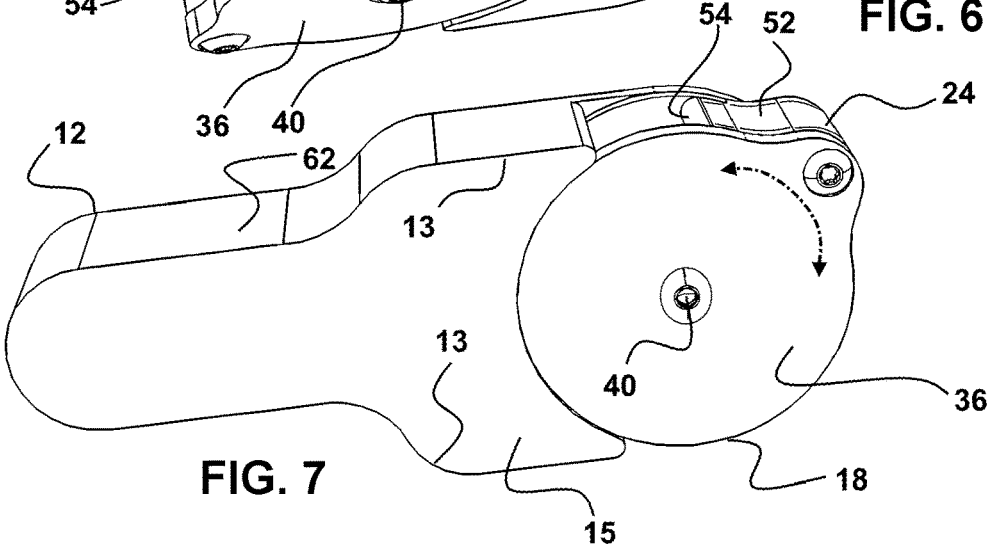

FIG. 7 shows a second or rear side view of the device herein of FIGS. 1-3, showing the key reel in a pivoting engagement at one end of the housing.

Figure 8:
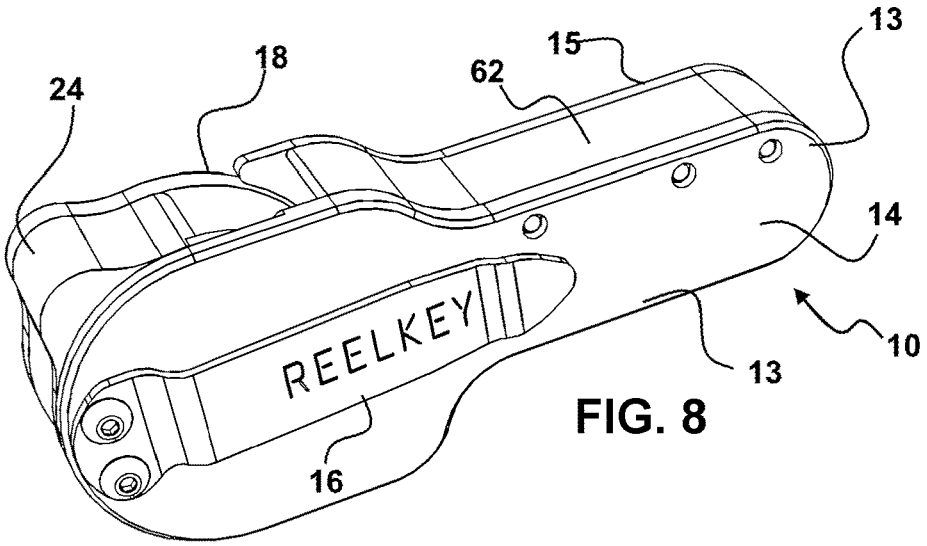

FIG. 8 is an overhead perspective view of a mode of the device herein showing the key reel in a pivoting engagement with the housing which is formed with a removable side and showing a projection extending from the key reel for use by the user to pivot the key reel.

Figure 9:
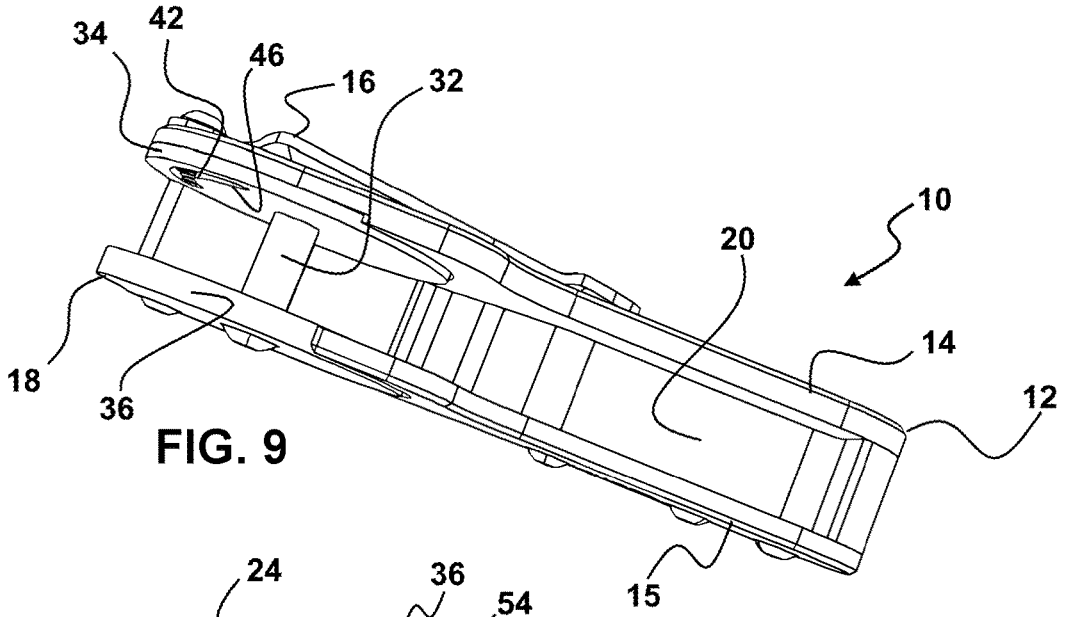

FIG. 9 is a lower perspective view of the device herein as in FIG. 8, showing the key reel pivotally engaged to the housing of the device, and showing the internal cavity of the housing.

Figure 10:
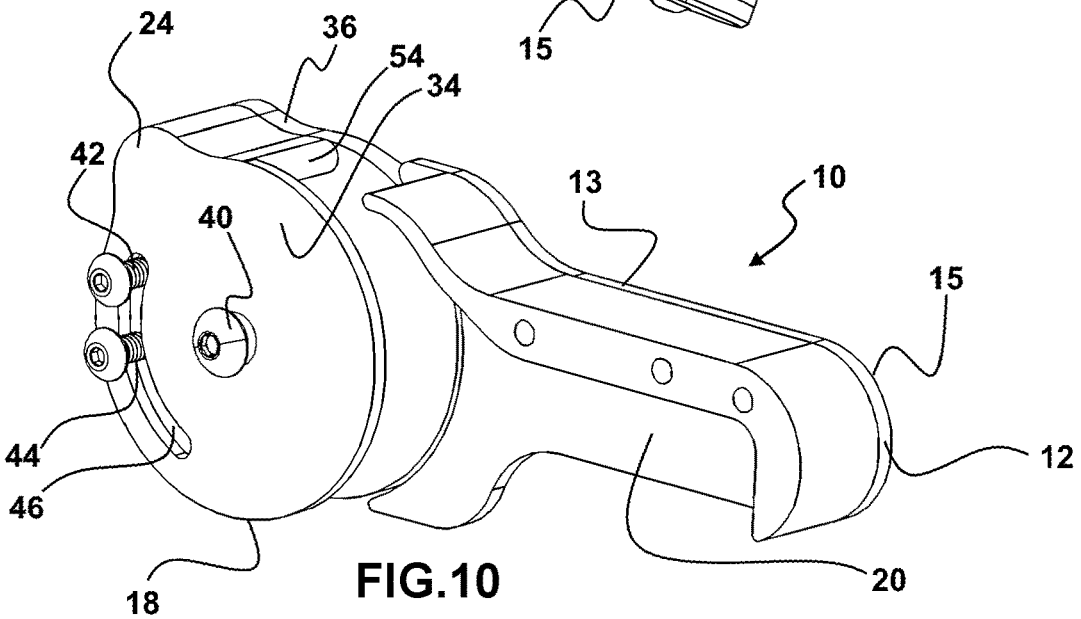

FIG. 10 shows the device as in FIG. 8, but with a first sidewall and clip removed to reveal the internal cavity of the housing and showing the pivoting engagement of the key reel thereto, and stops which communicate through a slot in a first sidewall to limit rotational travel.

DETAILED DESCRIPTION OF THE INVENTION

In this description, the directional prepositions of up, upwardly, down, downwardly, front, back, top, upper, bottom, lower, left, right, first, second, and other such terms refer to the device as it is oriented and appears in the drawings and all such terms are used for convenience only and such are not intended to be limiting or to imply that the device has to be used or positioned in any particular orientation.

Now referring to drawings in FIGS. 1-10, wherein similar components are identified by like reference numerals, there is seen in FIG. 1 the key organizer device 10. The device 10, as shown, has a housing 12 which has a first side 14 which may have a clip 16 engaged thereto, to allow the device to be engaged with a pocket or the like during storage. This first side 14 is positioned opposite the second side 15 of the housing 12.

As seen in FIG. 1-3 and in FIGS. 6-8, in all modes of the device 10 herein, a reel 18 is pivotally engaged with the housing 12 to rotate between a first position or retracted position, as in FIG. 1, wherein the keys 22, which are engaged to the reel 18 which is rotationally attached to the housing, are held within an internal cavity 20 (FIGS. 6, 9-10) and a second position or deployed position, as in FIG. 2, wherein any keys 22 engaged with the reel 18 are pivoted to have a front portion 23 of the key 22 projecting from an opening 21 communicating with the internal cavity 20 and are, thus, pivoted outside the internal cavity 20. In this projecting position of a key 22, engaged with the reel 18, the front portion 23 of the keys 22, which is configured to engage with a mating lock, may engage with that lock actuated by the key 22.

This pivoting of the reel 18 with the housing 12, between the two positions, which pivots the key 22, is actuated by the user by pushing upon a curved projection 24 which extends from the reel 18 a distance beyond a circumferential edge 13 of the housing 12. The curved-shaped projection 24, being part of or engaged to the reel 18, defines a lever to move the reel 18 between the first position thereof and the second position thereof. The reel 18 is curved in shape so as not to catch on the contents of any pocket or purse or the like during storage and is preferred. The projection 24 has a first curved side surface 26 on an opposite side of the projection 24 from a second curved side surface 28. The curve in both side surfaces, intersecting at a curved peak of the projection 24, renders the projection 24 easily engaged by a thumb or finger of the user to rotate the reel 18 between the first or retracted position shown in FIG. 1 and the second or deployed position shown in FIG. 2.

Shown in FIG. 3 is an overhead perspective view of the device, as in FIGS. 1-2, wherein the clip 16 has been removed. As shown, an engageable center pin 30 communicates through the first side 14 of the housing 12 and rotationally engages with the drum 32 (FIGS. 6 and 9) portion of the reel 18 which extends between a first reel sidewall 34 and a second reel sidewall 36. The center pin 30, thus, forms a rotational engagement of the reel 22 with the housing 12. Currently, a favored mode for the center pin 30 rotationally engages the reel 18 to the first side 14, such that the entire reel 18 will pivot between the first position of FIG. 1 and second position of FIG. 2 in this engagement. As shown, the first side 14 of the housing is longer than the second side 15, such that a projecting portion 19 of the first side 14 extends from the housing 12. It is this projecting portion 19 to which the reel 18 is pivotally engaged by the center pin 30.

As shown, the reel 18 is pivotally engaged to the housing 12, such as by a center pin 30 engaged with both the reel 18 and the first side 14 of the housing shown in FIGS. 3 and 6. The center pin 30 may communicate through an aperture in the first side 14 to a threaded engagement in an opening 40 in the drum 32 (see FIG. 5), or the center pin 30 may communicate axially through the drum 32 and be threadably engaged with the opposite sidewall of the opening 40 as shown in FIG. 7, or the center pin 30 may be otherwise engaged through and to the projecting portion 19 of the first side 14 and achieve the pivoting engagement of the reel 18 with the first side 14 of the housing 12.

This rotational or pivoting engagement of the reel 18 to one of the sides 14 or 15 of the housing 12 may also be formed in modes as would occur to those skilled in the art, such as by placing the projecting portion 19 of the housing 12 on the second side 15 rather than the first side 14.

The device 10 preferably includes a pivot distance limiter which will limit and stop the pivoting of the reel 18 at both the first position of FIG. 1 and the second position of FIG. 2. Currently, a preferred pivot distance limiter is formed by at least a first pin 42 which is in a threaded engagement with the first side 14 or second side 15 of the housing 12, and projects into a curved slot 46 formed into the first reel side 34 or second reel side 36 as the case may be. The slot 40 can be seen in FIG. 10, which shows the device 10 with the first side 14 removed to reveal the interior of the device 10. A second pin 44 may also be included if more adjustment is desired of the travel distance of pivoting of the reel 18.

In FIG. 4 is depicted the key reel 18 removed from the housing 12 of the device herein. As shown, the first side 34 of the reel 18 is removed and a first end of a key 22 is shown operatively engaged to the reel 18 by communication of the drum 32 of the reel 18 which is configured for passage through a hole 48, which is formed through the firs end or head portion of conventional keys 22. Additionally shown is a biased washer 50 which forms or defines the frictional restraint, such as is shown in FIG. 5, to maintain the key 22 in a static position upon the reel 18. By static engagement is meant that the first end or head of the key will rotate concurrently with the pivoting of the reel. Maintaining the keys 22 in a fixed or static engagement upon the reel 18 allows them to move concurrently with the reel 18 as it moves between the first or retracted position of FIG. 1 and the second or projecting position of FIG. 2 and, thus, places the key or keys 22 in position to operate a lock, when the user pivots the reel 18 to thereby pivot any key 22 engaged thereto.

Also shown in FIG. 4 is a pivot member 52 which forms a central wall extending in between the first side 34 of the reel and the second side 36 of the reel. When the reel 18 is pivoted by moving the projection 24, should the key 22 not rotate at the same time, the leading end 54 of the pivot member 52 will contact the head portion of the key and cause it to rotate out of the internal cavity 20. However, with the frictional restraint, as shown and described in FIG. 5, or another means for fixed portioning of the key on the reel 18, the key 22 will be frictionally or otherwise held in a static position relative to the reel 18 and should normally rotate to project from the interior cavity 20 once the reel 18 is pivoted to the second position as in FIG. 2.

Such a frictional restraint is shown, for example, in FIG. 5. By frictional restraint is meant that the key 22 engaged to the drum 32 of the reel 18 is held in a static position by frictional contact imparted by the frictional restraint but can be moved on its engagement to the drum 32 by imparting sufficient force to the key 22 to overcome the frictional engagement so imparted.

A currently preferred frictional restraint, as shown in FIG. 5, is formed by a biasing member 58, such as a spring, which imparts biasing force against the washer 50. With the key 22 engaged upon the drum 32, the key 22 is sandwiched between the washer 50 and one side of the reel 18, such as the second side 36 as shown in FIG. 5. The biasing force of the biasing member 58, thus causes frictional contact on both side surfaces of the key 22 form the side of the reel 18 and the washer 50. Of course other frictional restraints may be employed as would occur to those skilled in the art. However, at this juncture, the biasing member 58 has shown to work well in experimentation.

Shown in FIG. 6 is a perspective lower side view of the device 10 of FIGS. 1-3, wherein the housing 12 is formed in a unitary structure where the internal cavity 22 is located in between the first side 14 and a second side 15 and where the housing is formed in a single component. As shown, a central wall 62 extends between the first side 14 and second side 15 and the interior cavity 20 is situated between the first side 14 and second side 15 and the central wall 62.

Also shown in FIG. 6, and in FIG. 7 which shows the device as in FIG. 6 from the second side 15, is the reel 18 pivotally engaged to the projecting portion of the first side 14 of the formed housing 12. As with the other figures herein, the projection 24 is formed by an extension of at least one of the first side 34 of the reel 18 or the second side 36 of the reel 18. Preferably, as shown in FIG. 10, the projection 24 is formed of curved extensions of both the first side 34 and the second side 36 of the reel 18, and the pivot member 52 extends therebetween and an exterior surface defines a contact surface 64 for the user to press upon and pivot the reel 18.

FIGS. 8-10 depict the device 10 in a mode wherein the first side 14 is removably engageable to the housing 12. However, the mode in FIG. 8-10 functions the same as that of FIGS. 1-7 but with the ability to remove the first side 14, which is engaged to the housing 12 with fasteners as shown in FIG. 8.

As noted, any of the different configurations and components can be employed with any other configuration or component shown and described as part of the key organizer herein. Additionally, while the disclosed key organizer invention has been described herein with reference to particular embodiments thereof and components engaged for operation, a latitude of modifications, various changes and substitutions are intended in the foregoing disclosures and it will be appreciated that in some instance some features, or configurations, or operations of the invention could be employed without a corresponding use of other features without departing from the scope of the invention as set forth in the following claims. All such changes, alternations and modifications as would occur to those skilled in the art, are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. A key organizer apparatus, comprising:

a housing, said housing having an internal cavity communicating with an opening;

a reel, said reel adapted to engage with a first end of a key, said reel in a pivoting engagement with said housing to move between a first position and a second position;

a projection on said reel, said projection extending past a circumferential edge of said housing;

said projection defining a lever to pivot said reel between said first position and said second position;

said reel pivotable to said first position for positioning a second end of a said key engaged therewith, within said interior cavity;

said reel pivotable to said second position for positioning said second end of said key engaged therewith to project through said opening, wherein said second end of said key is positioned to engage with a lock.

2. The key organizer apparatus of claim 1, additionally comprising:

said projection having a first curved side opposite a second curved side and having a curved peak positioned between said first curved side and second curved side.

3. The key organizer apparatus of claim 1, additionally comprising:

said housing having a first side opposite a second side;

said first side having a projecting portion at a first end of said housing; and said pivoting engagement of said reel with said housing positioned upon said projecting portion.

4. The key organizer apparatus of claim 2, additionally comprising:

said housing having a first side opposite a second side;

said first side having a projecting portion at a first end of said housing; and said pivoting engagement of said reel with said housing positioned upon said projecting portion.

5. The key organizer apparatus of claim 1, additionally comprising:

said reel adapted for said engagement with said first end of a key in a static engagement therebetween.

6. The key organizer apparatus of claim 2, additionally comprising:

said reel adapted for said engagement with said first end of a key in a static engagement therebetween.

7. The key organizer apparatus of claim 3, additionally comprising:

said reel adapted for said engagement with said first end of a key in a static engagement therebetween.

8. The key organizer apparatus of claim 4, additionally comprising:

said reel adapted for said engagement with said first end of a key in a static engagement therebetween.

9. The key organizer apparatus of claim 1, additionally comprising:

said reel having a drum, said reel adapted to engage said first end of said key upon said drum; and a biasing member engaged with said drum, said biasing member for imparting a biasing force against said first end of said key.

10. The key organizer apparatus of claim 5, additionally comprising:

said reel having a drum, said reel adapted to engage said first end of said key upon said drum; and a biasing member engaged with said drum, said biasing member for imparting a biasing force against said first end of said key.

11. The key organizer apparatus of claim 3, additionally comprising:

a pivoting distance limiter for limiting a distance of rotation of said reel in said pivoting engagement; and said pivoting distance limiter defined by a curved slot formed through a reel sidewall having a pin engaged with said projecting portion.

* * * * *